US007965166B2

(12) United States Patent
Okawa et al.

(10) Patent No.: US 7,965,166 B2
(45) Date of Patent: Jun. 21, 2011

(54) MULTI-LAYERED DEVICE

(75) Inventors: Masanao Okawa, Nara (JP); Hirofumi Konishi, Hirakata (JP)

(73) Assignee: Panasonic Electric Works Co., Ltd., Osaka (JP)

( * ) Notice: Subject to any disclaimer, the term of this patent is extended or adjusted under 35 U.S.C. 154(b) by 0 days.

(21) Appl. No.: 12/524,451

(22) PCT Filed: Jan. 28, 2008

(86) PCT No.: PCT/JP2008/051160

§ 371 (c)(1),
(2), (4) Date: Aug. 20, 2009

(87) PCT Pub. No.: WO2008/091006

PCT Pub. Date: Jul. 31, 2008

(65) Prior Publication Data

US 2010/0079232 A1 Apr. 1, 2010

(30) Foreign Application Priority Data

Jan. 26, 2007 (JP) ..... 2007-016737

(51) Int. Cl.
*H01F 5/00* (2006.01)

(52) U.S. Cl. ..... 336/200; 336/223; 336/232

(58) Field of Classification Search ..... None
See application file for complete search history.

(56) References Cited

U.S. PATENT DOCUMENTS

| | | | | | |
|---|---|---|---|---|---|
| 2,911,605 | A | * | 11/1959 | Wales, Jr. | 336/200 |
| 3,484,731 | A | * | 12/1969 | Rich | 336/200 |
| RE30,183 | E | * | 1/1980 | Popenoe | 73/761 |
| 4,369,557 | A | * | 1/1983 | Vandebult | 29/25.42 |
| 5,276,421 | A | * | 1/1994 | Boitard | 336/180 |
| 5,801,611 | A | * | 9/1998 | Van Loenen et al. | 336/200 |
| 2008/0113168 | A1 | | 5/2008 | Nakashiba et al. | |
| 2009/0104565 | A1 | | 4/2009 | Nakashiba et al. | |

FOREIGN PATENT DOCUMENTS

JP 52-088762 7/1977

(Continued)

OTHER PUBLICATIONS

English language Abstract of JP 11-016729, Jan. 22, 1999.

(Continued)

*Primary Examiner* — Anh T Mai

(74) *Attorney, Agent, or Firm* — Greenblum & Bernstein, P.L.C.

(57) ABSTRACT

A multilayered device comprises an insulation sheet 1 having at least two foldable areas 11, 12 which are multilayered by being folded; and a first conductor 21A, 22A which is formed on a first face 11A, 12A and constitutes a first coil 51A, 52A having one turn or more, and a second conductor 21B, 22B which is formed on a second face 11B, 12B and constitutes a second coil 51B, 52B having one turn or more in the same winding direction as that of the first coil in each of the foldable areas, at least four conductors are disposed in parallel with each other by folding the insulation sheet so as to constitute an inductor, and thus, it enables to thin the thickness of the multilayer, to downsize and to lightweight even when it constitutes a coil device having a larger winding number.

10 Claims, 11 Drawing Sheets

FOREIGN PATENT DOCUMENTS

| | | | |
|---|---|---|---|
| JP | 58141513 A | * | 8/1983 |
| JP | 64-089305 | | 4/1989 |
| JP | 5-243057 | | 9/1993 |
| JP | 6-251945 | | 9/1994 |
| JP | 6-275439 | | 9/1994 |
| JP | 11-016729 | | 1/1999 |
| JP | 2005-222997 | | 8/2005 |

OTHER PUBLICATIONS

English language Abstract of JP 2005-222997, Aug. 18, 2005.
English language Abstract of JP 5-243057, Sep. 21, 1993.
English language Abstract of JP 6-275439, Sep. 30, 1994.
English language Abstract of JP 6-251945, Sep. 9, 1994.
English language Abstract of JP 64-089305, Apr. 3, 1989.

* cited by examiner

MULTI-LAYERED DEVICE

TECHNICAL FIELD

The present invention relates to a multilayered device which is configured by laminating insulation sheets with conductor coils.

BACKGROUND ART

For example, Japanese Laid-Open Patent Publication No. 5-243057 discloses a conventional multilayered device (a thin transformer) which is configured by laminating insulation sheets with conductor coils. In such conventional multilayered device, as shown in FIG. 14, conductors 200 which are formed of a material such as copper foil of a flexible printed circuit board to have coil shapes on a first face (front face) of a flexible insulation sheet 100 of foldable such as the flexible printed circuit board, for example. By laminating such insulation sheet 100, a multilayered device having a desired inductance value can be obtained.

FIG. 15A and FIG. 15B are figures respectively showing a first face (a front face) and a second face (a rear face) of adjoining two folded areas of the insulation sheet 100. In this example, the conductors 200 are formed as coil shape only on the first face (front face) 100A in FIG. 14, and no conductor is formed on the second face (rear face) 100B. As shown in FIG. 15A, the first coil 201 formed on a first foldable area 101 is electrically conducted to a second coil formed on a second foldable area 102. Under a condition that the insulation sheet 1 (SIC: 100) is folded so that the second faces (rear faces) of respective foldable areas are contacted, the first coil 201 of the first foldable area 101 and the second coil 202 of the second foldable area 102 are disposed in parallel with each other via the insulation sheet 100, so that an inductor is formed.

DISCLOSURE OF INVENTION

According to the above mentioned conventional multilayered device, since the coil shaped conductors are provided on only one face of the flexible insulation sheet 1 (SIC: 100), in order to constitute a coil device having a large number of turns, it is necessary to superimpose the single-sided flexible insulation sheets 1 (SIC: 100) each of which is folded to contact the rear faces several times via insulation sheets, and thus, there is a problem that a thickness of the multilayered device increases.

The present invention is conceived to solve such problem of the conventional one, and purposes to provide a multilayered device which enables to reduce the thickness of the lamination and to downsize and to lighten by arranging the conductors on both sides of the insulation sheet effectively, even when it constitute a coil device having a large number of turns.

A multilayered device in accordance with an aspect of the present invention comprises:

an insulation sheet having at least two foldable areas which are multilayered by being folded; and a first conductor which is formed on a first face of each of the foldable areas and constitutes a first coil of at least one turn, and a second conductor which is formed on a second face of each of the foldable areas and constitutes a second coil of at least one turn having the same winding direction as that of the first coil, and wherein at least four conductors are disposed in parallel with each other by folding the insulation sheet so as to form an inductor.

According to such a configuration, since the first conductor which constitutes the first coil is formed on the first face of each foldable area and the second conductor which constitutes the second coil having the same winding direction as that of the first coil is formed on the second face, by folding the insulation sheet so that respective foldable areas are folded, at least four layers of the conductors constituting coils having the same winding directions are multilayered via the insulation sheets. Consequently, in comparison with the conventional multilayered device in which the conductors are formed on only one side of the insulation sheet, when a number of layers of the conductors of the devices are the same, it is possible to downsize and to thin the device. Alternatively, when the sizes of the devices are substantially the same, it is possible to obtain an inductor having a larger inductance value or a capacitor having a larger capacitance value.

BEST MODE FOR CARRYING OUT THE INVENTION

First Embodiment

Figure 1A:
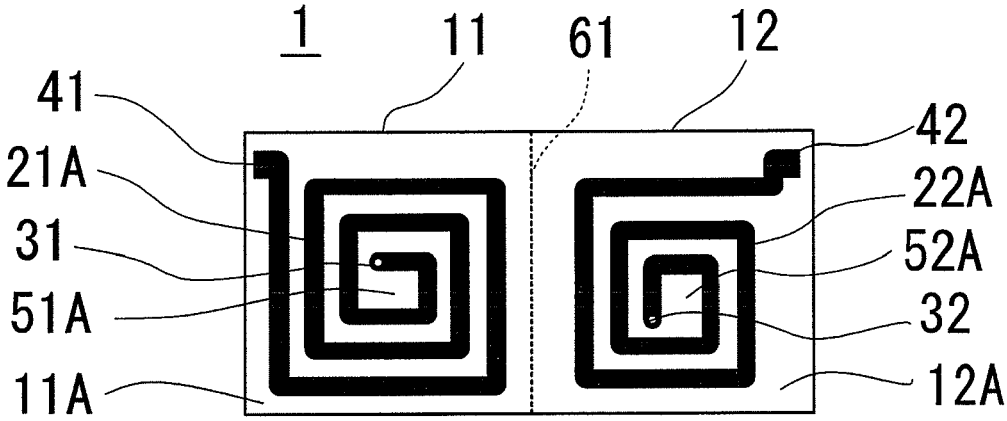
FIG. 1A is a drawing showing a configuration of and patterns of conductors on a first face (front face) of an insulation sheet which constitutes a multilayered device in accordance with a first embodiment of the present invention.
Figure 1B:
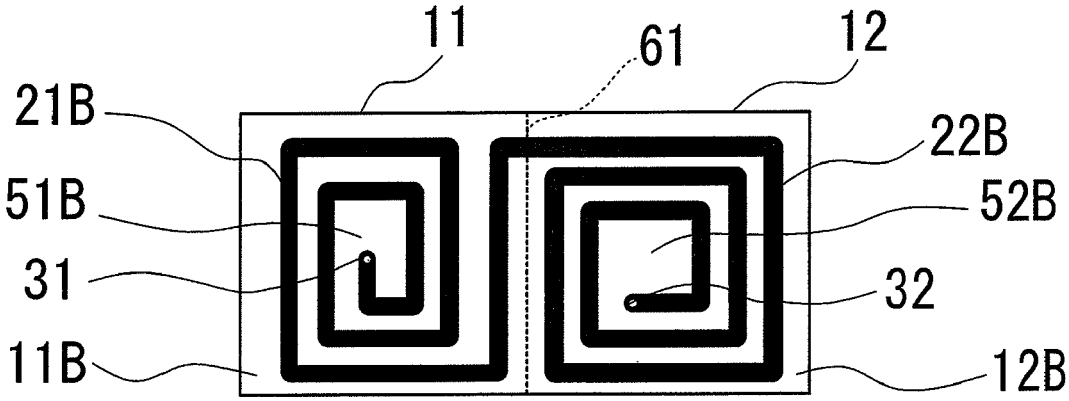
FIG. 1B is a drawing (transparent image) showing a configuration of and patterns of conductors on a second face (rear face) thereof.

A multilayered device in accordance with a first embodiment of the present invention is described with reference to FIG. 1A and FIG. 1B. FIG. 1A shows a configuration of and patterns of conductors on a first face (front face) of an insulation sheet 1 which constitutes the multilayered device, and FIG. 1B shows a configuration of and patterns of conductors on a second face (rear face) thereof. Hereupon, the patterns of the conductors on the second face (rear face) shown in FIG. 1B are illustrated as patterns transparently observed from the same side of the patterns of the first face (front face). Therefore, when the patterns of the conductors on the second face (rear face) are observed from the second face side, the delineation will be reversed (the same goes for the following embodiments).

As shown in FIG. 1A and FIG. 1B, in the multilayered device in accordance with the first embodiment, the insulation sheet 1 has two foldable areas, that is, the first foldable area 11 and the second foldable area 12, which are to be multilayered by being folded. In the first foldable area 11, a first conductor 21A which constitutes a first coil 51A having one turn or more is formed on a first face 11A, and a second conductor 21B which constitutes a second coil 51B having one turn or more in the same winding direction as the first coil 51A is formed on a second face 11B. Similarly, in the first (SIC: second) foldable area 12, a first conductor 22A which constitutes a first coil 52A having one turn or more is formed on a first face 12A, and a second conductor 22B which constitutes a second coil 52B having one turn or more in the same winding direction as that of the first electric coil 52A when observing from a second face side is formed on the second face 12B.

Under a state that the insulation sheet 1 is folded, the first conductor 21A on the first face 11A of the first foldable area 11 has a connection terminal 41 which is formed at an upper left portion of the first face 11A and is to be connected to an external circuit, and the first coil 51A which converges towards a center while forming a convolution in counterclockwise direction along each side of the first foldable area 11 from the connection terminal 41. In addition, the second conductor 21B on the second face 11B of the first foldable area 11 has the second coil 51B which diverges towards a periphery while forming a convolution in counterclockwise direction along each side of the first foldable area 11 from a center of the second face 11B (in a condition seen through). Furthermore, a via hole (penetration conductor) 31 which conducts the first conductor 21A and the second conductor 21B is formed to penetrate from the first face 11A to the second face 11B at the center of the first foldable area 11.

As shown in FIG. 1B, the second conductor 22B on the second face 12B of the second foldable area 12 has a second coil 52B which is successively formed from the second face 11B of the first foldable area 11 to bridge over a folding line 61 between the first foldable area 11 and the second foldable area 12, and to converge towards a center while forming a convolution in clockwise direction along each side of the second foldable area 12. In addition, the first conductor 22A on the first face 12A of the second foldable area 12 has a first coil 52A which diverges towards a periphery while forming a convolution in clockwise direction along each side of the second foldable area 12 from a center of the first face 12A (in a condition seen through), and a connection terminal 42 which is formed at an upper right portion of the first face 12A and is to be connected to an external circuit. Furthermore, a via hole 32 which conducts the first conductor 22A and the second conductor 22B is formed to penetrate from the first face 12A to the second face 12B at the center of the second foldable area 12.

Under a state that the insulation sheet 1 is folded, the winding direction of the first coil 51A and the second coil 51B in the first foldable area 11 and the winding direction of the first coil 52A and the second coil 52B in the second foldable area 12 are opposite to each other. When the insulation sheet 1 is folded as valley fold along the folding line 61 in FIG. 1B so that the second face 11B of the first foldable area 11 and the second face 12B of the second folding area 12 touch each other, a multilayered coil is constituted by folding four coils 51A, 51B, 52A and 52B each having one turn or more wound in the same direction by four conductors 21A, 21B, 22A and 22B which are electrically connected, and thus, an inductor device is provided.

In addition, it is necessary to insulate at least the folded portion of the insulation sheet 1 by interleaving another insulation sheet between the foldable areas of the insulation sheet so as not to be short-circuited the second conductor 21B on the second face of the first foldable area 11 and the second conductor 22B on the second face of the second foldable area 12 which will touch each other in folded state, for example. Alternatively, it is possible to provide thin insulation sheets or insulation films to cover surfaces of the conductors 21A, 21B, 22A and 22B other than the connection terminals 41 and 42.

Second Embodiment

Figure 2A:
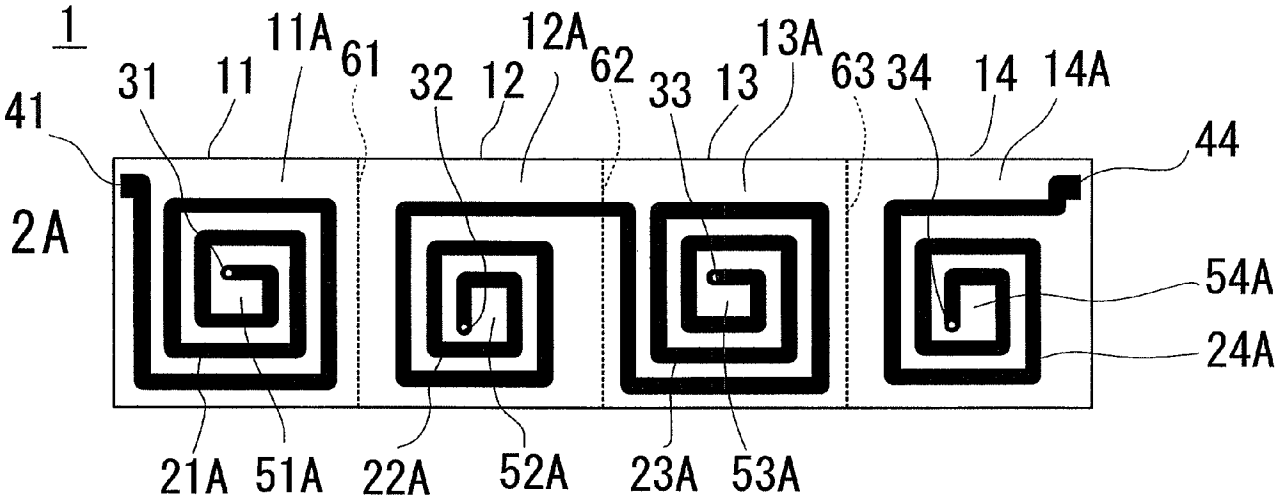
FIG. 2A is a drawing showing a configuration of and patterns of conductors on a first face (front face) of an insulation sheet which constitutes a multilayered device in accordance with a second embodiment of the present invention.
Figure 2B:
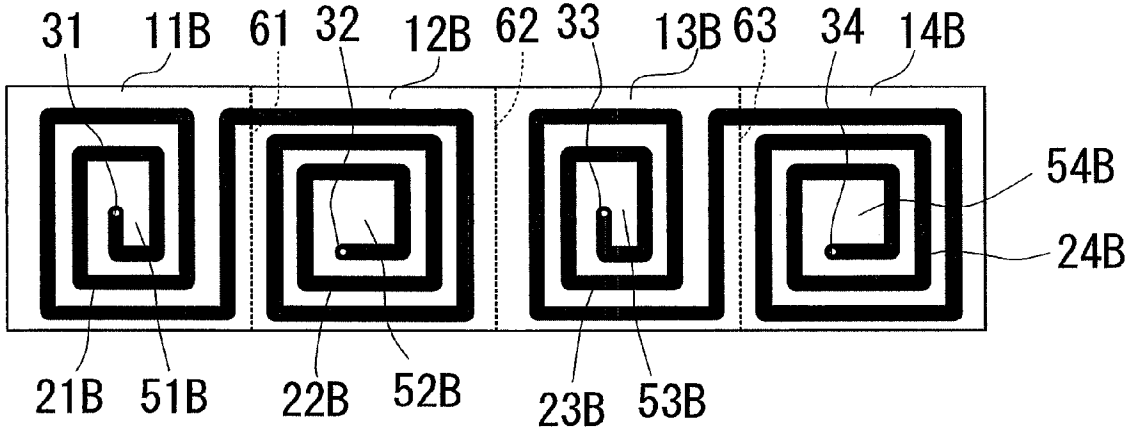
FIG. 2B is a drawing (transparent image) showing a configuration of and patterns of conductors on a second face (rear face) thereof.

Subsequently, a multilayered device in accordance with a second embodiment of the present invention is described with reference to FIG. 2A and FIG. 2B. FIG. 2A shows a configuration of and patterns of conductors on a first face (front face) of an insulation sheet 1 which constitutes the multilayered device, and FIG. 2B shows a configuration of and patterns of conductors on a second face (rear face) thereof. Hereupon, the patterns of the conductors on the rear face shown in FIG. 2B are illustrated as patterns transparently observed from the same side of the patterns of the front face, similar to the above mentioned first embodiment. In addition, explanation of elements common in the above mentioned first embodiment are omitted (the same goes for the following embodiments).

In the second embodiment shown in FIG. 2A and FIG. 2B, an insulation sheet 1 is configured by four foldable areas 11 to 14. With respect to two foldable areas 11 and 12 adjoining each other, a foldable area 11 corresponds to the above first foldable area and a foldable area 12 corresponds to the above second foldable area. In addition, with respect to two foldable areas 12 and 13 adjoining each other, the foldable area 12 corresponds to the above first foldable area and a foldable area 13 corresponds to the above second foldable area. Similarly, with respect to two foldable areas 13 and 14 adjoining each other, the foldable area 13 corresponds to the above first foldable area and a foldable area 14 corresponds to the above second foldable area.

Connecting terminals 41 and 44 which are to be connected to an external circuit are respectively provided on first faces 11A and 14A of the foldable areas 11 and 14 at both ends, and a first conductor 22A on a first face 12A of the foldable area 12 and a first conductor 23A on a first face 13A of the foldable area 13 are successively formed to bridge over a folding line 62 between the foldable area 12 and the foldable area 13. In addition, a second conductor 21B on a second face 11B of the foldable area 11 and a second conductor 23B on a second face 13B of the foldable area 13, and a second conductor 22B on a second face 12B of the foldable area 12 and a second conductor 24B on a second face 14B of the foldable area 14 respectively have the same patterns. On the other hand, a first conductor 21A on a first face 11A of the foldable area 11 and a first conductor 23A on a first face 13A of the foldable area 13, and a first conductor 22A on a first face 12A of the foldable area 12 and a first conductor 2AB (SIC; 24A) on a first face 14A of the foldable area 14 respectively have substantially the same but not precisely the same patterns other than connection terminal portions.

When folding the insulation sheet 1 in accordance with the second embodiment as valley fold along folding lines 61 and 63 and as mountain fold along a folding line 62 in FIG. 2B, a multilayered coil is constituted by folding eight coils 51A, 51B, 52A, 52B, 53A, 43B, 54A and 54B each having one turn or more wound in the same direction by eight conductors 21A, 21B, 22A, 22B, 23A, 23B, 24A and 24B which are electrically connected, and thus, it can be used as an inductor device. Consequently, the patterns shown in FIG. 2A and FIG. 2B are equivalent to a series connection of tow sets of patterns shown in FIG. 1A and FIG. 1B, so that an inductance device having twofold value of inductance is obtained in comparison with the configuration in the first embodiment.

Besides, a number of foldable areas of the insulation sheet 1 is not limited to two in the above mentioned first embodiment or four in the second embodiment, and it is possible to select an optional number regardless of an even number or an odd number.

Third Embodiment

Figure 3A:
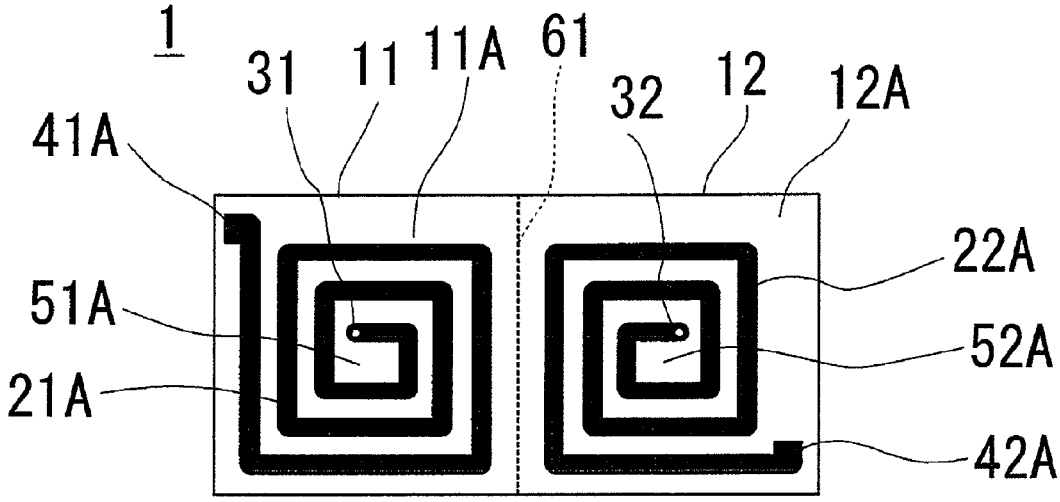
FIG. 3A is a drawing showing a configuration of and patterns of conductors on a first face (front face) of an insulation sheet which constitutes a multilayered device in accordance with a third embodiment of the present invention.
Figure 3B:
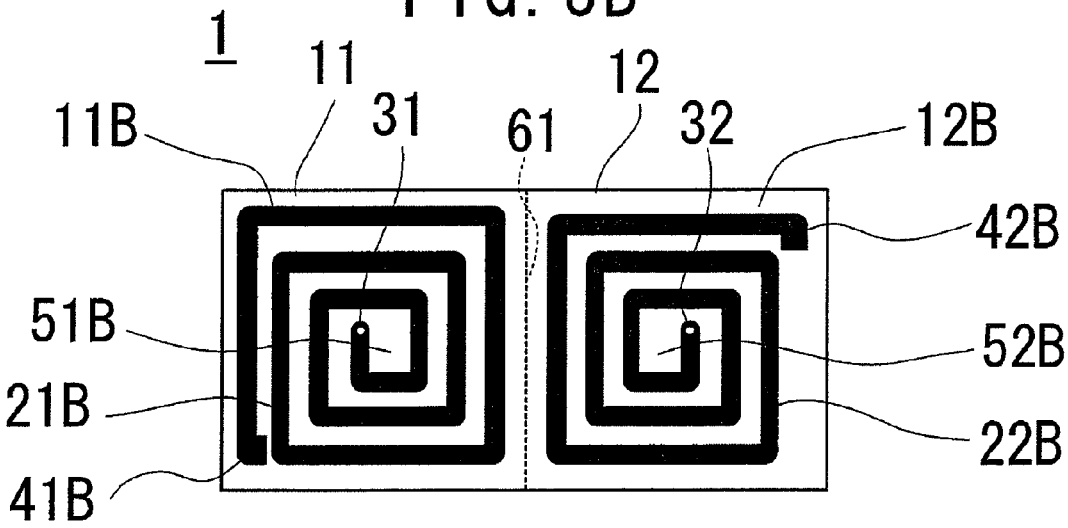
FIG. 3B is a drawing (transparent image) showing a configuration of and patterns of conductors on a second face (rear face) thereof.

Subsequently, a multilayered device in accordance with a third embodiment of the present invention is described with reference to FIG. 3A and FIG. 3B. FIG. 3A shows a configuration of and patterns of conductors on a first face (front face) of an insulation sheet 1 which constitutes the multilayered device, and FIG. 3B shows a configuration of and patterns of conductors on a second face (rear face) thereof. Hereupon, the patterns of the conductors on the rear face shown in FIG. 3B are illustrated as patterns transparently observed from the same side of the patterns of the front face, similar to the above mentioned first embodiment.

The multilayered device in accordance with the third embodiment is configured as a transformer having two windings. An insulation sheet 1 has two foldable areas, that is, a first foldable area 11 and a second foldable area 12, which are to be multilayered by being folded. First conductors 21A and 22A, which constitute first coils 51A and 52A each having one turn or more, are formed on first faces 11A and 12A of respective foldable areas 11 and 12. Similarly, second conductors 21B and 22B, which constitute second coils 51B and 52B each having one turn or more in the same winding direction as that of the first coils 51A and 52A, are formed on second faces 11B and 12B of respective of the foldable areas 11 and 12. In addition, in respective of the foldable areas 11 and 12, via holes 31 and 32, which conduct the first conductors 21A and 22A to the second conductors 21B and 22B, are provided to penetrate from the first faces 11A and 12A to the second faces 11B and 12B. Besides, the first conductor 21A and the second conductor 21B formed on the first face 11A and the second face 11B of the first foldable area 11 are electrically insulated from the first conductor 22A and the second conductor 22B formed on the first face 12A and the second face 12B of the second foldable area 12.

As shown in FIG. 3A and FIG. 3B, in a state that the insulation sheet 1 is folded, the first conductor 21A on the first face 11A in the first foldable area 11 has a connection terminal 41A which is provided at upper left portion of the first face 11A and to be connected to an external circuit, and the first coil 51A which converges towards a center while forming a convolution in counterclockwise direction along each side of the first foldable area 11 from the connection terminal 41A. In addition, the second conductor 21B on the second face 11B of the first foldable area 11 has the second coil 51B which diverges towards a periphery while forming a convolution in counterclockwise direction along each side of the first foldable area 11 from a center of the second face 11B (in a condition seen through), and a connection terminal 41B which is provided at lower left portion of the second face 11B and to be connected to the external circuit. Furthermore, a via hole 31 which conducts the first conductor 21A and the second conductor 21B is formed to penetrate from the first face 11A to the second face 11B at the center of the first foldable area 11.

On the other hand, the first conductor 22A on the first face 12A in the second foldable area 12 has a connection terminal 42A which is provided at lower left portion of the first face 12A and to be connected to another external circuit, and the first coil 52A which converges towards a center while forming a convolution in clockwise direction along each side of the second foldable area 12 from the connection terminal 42A. In addition, the second conductor 22B on the second face 12B of the second foldable area 12 has the second coil 52B which diverges towards a periphery while forming a convolution in clockwise direction along each side of the second foldable area 12 from a center of the second face 12B (in a condition seen through), and a connection terminal 42B which is provided at upper right portion of the second face 12B and to be connected to the another external circuit. Furthermore, a via hole 32 which conducts the first conductor 22A and the second conductor 22B is formed to penetrate from the first face 12A to the second face 12B at the center of the second foldable area 12. In other words, in the state that the insulation sheet 1 is folded, the winding direction of the first coil 51A and the second coil 52B of the first foldable area 11 and the winding direction of the first electric coil 52A and the second electric coil 52B of the second foldable area 12 are opposite to each other.

When the insulation sheet 1 in accordance with the third embodiment is folded as valley fold along the folding line 61 in FIG. 3B, the first coil 51A formed on the first face 11A and the second coil 51B formed on the second face 51B of the first foldable area 11 constitute an inductor through the via hole 31. In addition, the first coil 52A formed on the first face 12A and the second coil 52B formed on the second face 52B (SIC: 12B) of the second foldable area 12 constitute an inductor through the via hole 31 (SIC: 32). Consequently, a flat transformer in which two inductors are magnetically coupled is provided.

Fourth Embodiment

Figure 4A:
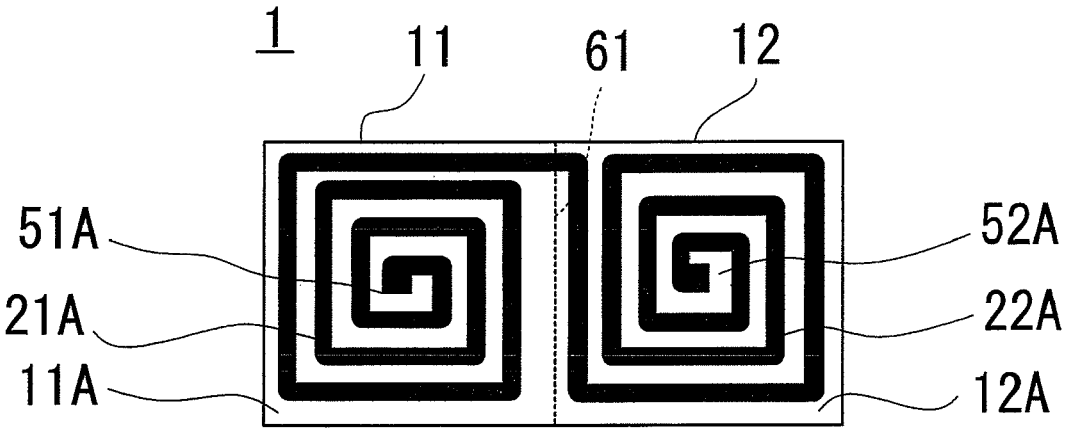
FIG. 4A is a drawing showing a configuration of and patterns of conductors on a first face (front face) of an insulation sheet which constitutes a multilayered device in accordance with a fourth embodiment of the present invention.
Figure 4B:
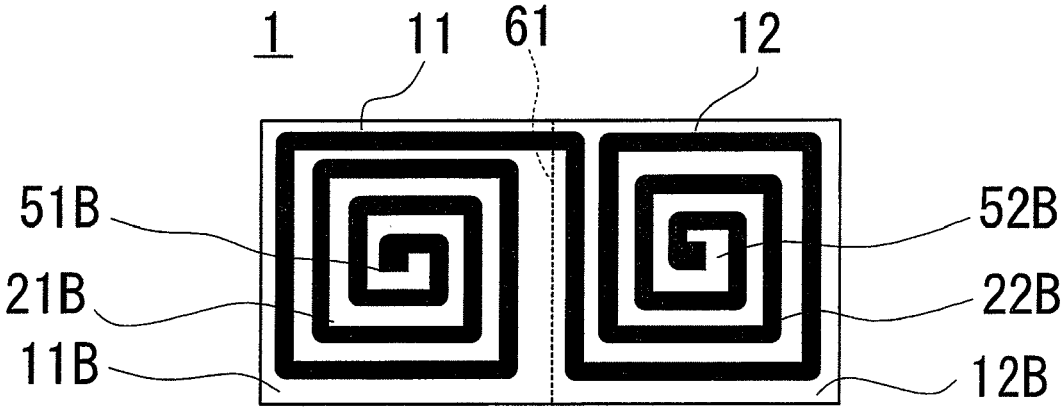
FIG. 4B is a drawing (transparent image) showing a configuration of and patterns of conductors on a second face (rear face) thereof.

Subsequently, a multilayered device in accordance with a fourth embodiment of the present invention is described with reference to FIG. 4A and FIG. 4B. FIG. 4A shows a configuration of and patterns of conductors on a first face (front face) of an insulation sheet 1 which constitutes the multilayered device, and FIG. 4B shows a configuration of and patterns of conductors on a second face (rear face) thereof. Hereupon, the patterns of the conductors on the rear face shown in FIG. 4B are illustrated as patterns transparently observed from the same side of the patterns of the front face, similar to the above mentioned first embodiment.

In the multilayered device in accordance with the fourth embodiment, conductors having the same patterns are formed on a first face (front face) and a second face (rear face) of the insulation sheet 1, so that a capacitor is formed between the conductors on the first face and the conductors on the second face.

As shown in FIG. 4A and FIG. 4B, the insulation sheet 1 has two foldable areas, that is, the first foldable area 11 and the second foldable area 12, which are to be multilayered by being folded. First conductors 21A and 22A which constitute first coils 51A and 52A having one turn or more are formed on first faces 11A and 12A of the foldable areas 11 and 12. Similarly, second conductors 21B and 22B which constitute second coils 51B and 52B having one turn or more are formed on second faces 11B and 12B of the foldable areas 11 and 12.

The first conductor 21A on the first face 11A of the first foldable area 11 has the first coil 51A which diverges towards a periphery while forming a convolution in clockwise direction along each side of the first foldable area 11 from a center of the first face 11A, and is formed to bridge over a folding line 61 between the first foldable area 11 and the second foldable area 12 and to continue to the first conductor 22A on the first face 12A of the second foldable area 12. In addition, the first conductor 22A on the first face 12A of the second foldable area 12 has the first coil 52A which converges towards a center while forming a convolution in counterclockwise direction along each side of the second foldable area 12.

Similarly, the first (SIC: second) conductor 21B on the second face 11B of the first foldable area 11 has the second coil 51B which diverges towards a periphery while forming a convolution in clockwise direction along each side of the first foldable area 11 from a center of the second face 11B (in a condition seen through), and is formed to bridge over a folding line 61 between the first foldable area 11 and the second foldable area 12 and to continue to the second conductor 22B on the second face 12B of the second foldable area 12. In addition, the second conductor 22B on the second face 12B of the second foldable area 12 has the second coil 52B which converges towards a center while forming a convolution in counterclockwise direction along each side of the second foldable area 12.

In the fourth embodiment, no via hole which conducts the first conductor 21A or 22A and the second conductor 21B or 22B is formed to penetrated from the first face 11A or 12A to the second face 11B or 12B in the foldable area 11 or 12, so that the first conductor 21A and the second conductor 21B formed on the first face 11A and the second face 11B of the first foldable area 11 and the first conductor 22A and the second conductor 22B formed on the first face 12A and the second face 12B of the second foldable area 12 are electrically insulated, respectively. Furthermore, as can be seen from FIG. 4A and FIG. 4B, the patterns of the conductors formed on the first face (front face) of the insulation sheet 1 are the same shape as the patterns of the conductors formed on the second face (rear face) (in a condition seen through).

When the insulation sheet 1 is folded as valley fold along the folding line 61 in FIG. 4B, four pieces of conductors each having the same patterns are arranged in parallel via insulation sheets, and two pieces of them located in most outward and two pieces of them located inside are electrically connected, respectively, so that a capacitor of distributed constant is provided.

Fifth Embodiment

Figure 5A:
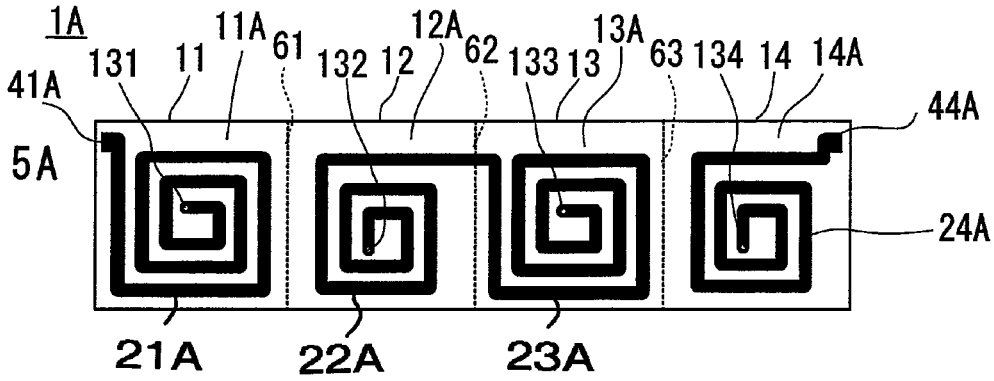
FIG. 5A is a drawing showing a configuration of and patterns of conductors on a first face (front face) of a first insulation sheet which constitutes a multilayered device in accordance with a fifth embodiment of the present invention.
Figure 5B:
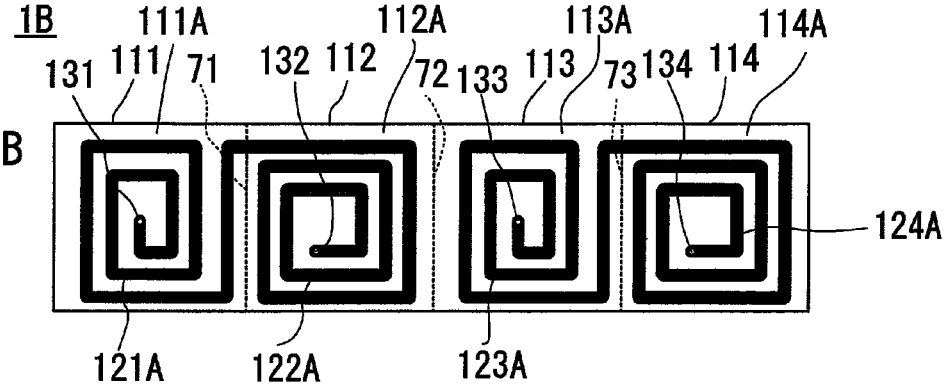
FIG. 5B is a drawing showing a configuration of and patterns of conductors on a first face (front face) of a second insulation sheet.
Figure 5C:
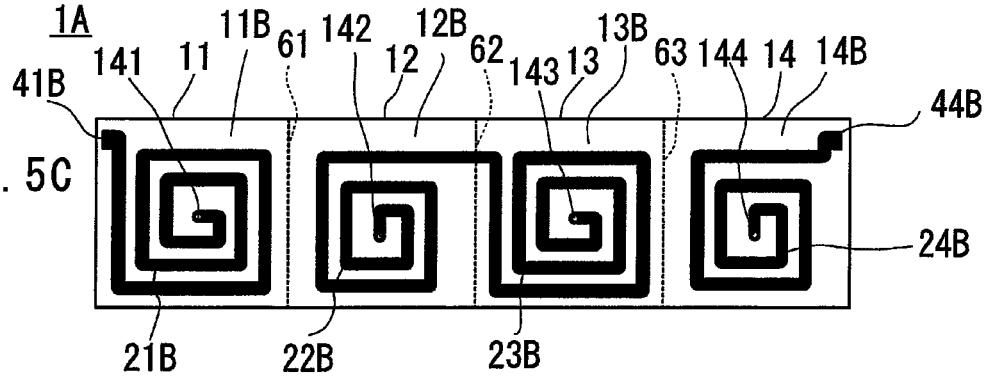
FIG. 5C is a drawing showing a configuration of and patterns of conductors on a second face (rear face) of the first insulation sheet.
Figure 5D:
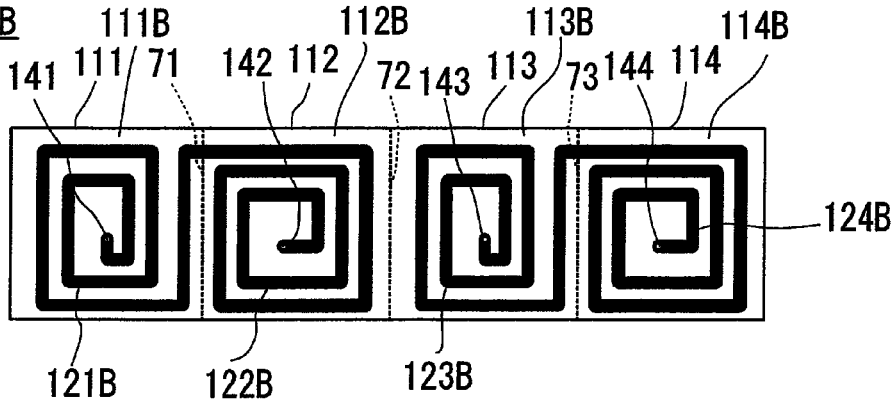
FIG. 5D is a drawing showing a configuration of and patterns of conductors on a second face (rear face) the second insulation sheet.

Subsequently, a multilayered device in accordance with a fifth embodiment of the present invention is described with reference to FIG. 5A to FIG. 5D and FIG. 6. FIG. 5A shows a configuration of and patterns of conductors on a first face (front face) of a first insulation sheet 1A which constitutes the multilayered device in accordance with the fifth embodiment of the present invention, FIG. 5B shows a configuration of and patterns of conductors on a first face (front face) of a second insulation sheet 1B, FIG. 5C shows a configuration of and patterns of conductors on a second face (rear face) of the first insulation sheet 1A, and FIG. 5D shows a configuration of and patterns of conductors on a second face (rear face) the second insulation sheet 1B. Hereupon, the patterns of the conductors on the rear faces shown in FIG. 5*c* and FIG. 5D are illustrated as patterns transparently observed from the same side of the patterns on the front face, similar to the above mentioned first embodiment. In addition, FIG. 6 is a partially expanded sectional view showing a configuration of a multilayered body of the insulation sheets in the fifth embodiment, and especially shows an enlarged center portion of the foldable areas in the multilayered body of the insulation sheets.

Figure 6:
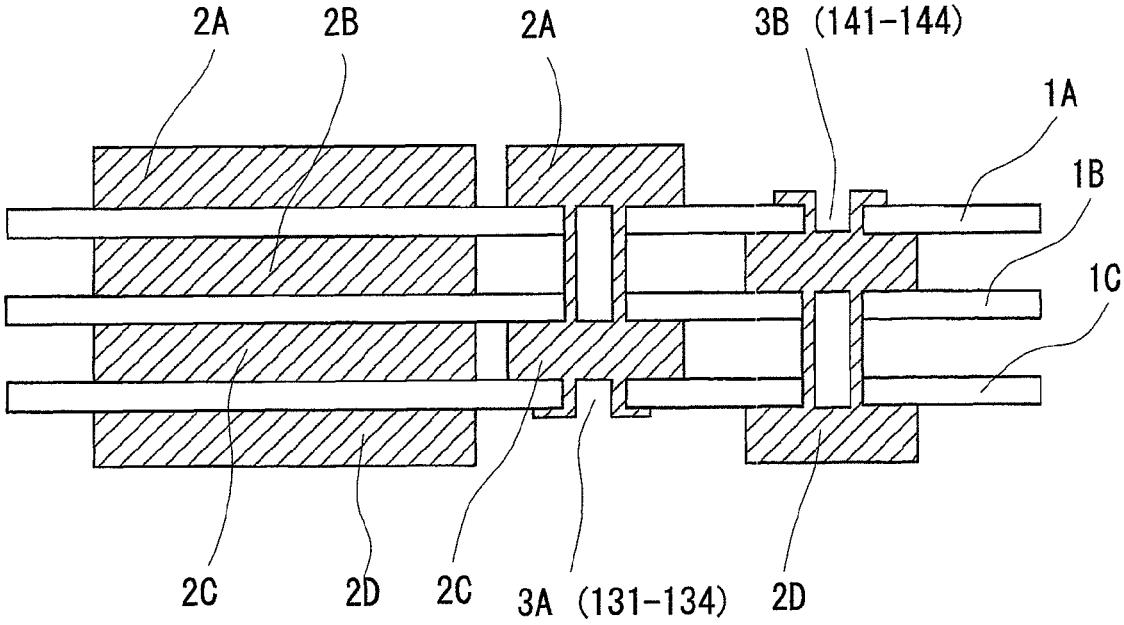
FIG. 6 is a partially expanded sectional view showing a configuration of a multilayered body of the insulation sheets in the fifth embodiment.

As can be seen from FIG. 6, in the multilayered device in accordance with the fifth embodiment, a plurality of insulation sheets 1A and 1B each having patterns of conductors formed on both faces thereof are multilayered, and the multilayered body is further multilayered by being folded along the folding lines. In comparison with the above mentioned second embodiment, the patterns of conductors formed on the first face and the second face of the first insulation sheet 1A shown in FIG. 5A and FIG. 5C are substantially the same as the patterns of conductors shown in FIG. 2A and the patterns of conductors formed on the first face and the second face of the second insulation sheet 1B shown in FIG. 5B and FIG. 5D are substantially the same as the patterns of conductors shown in FIG. 2B, so that detailed description of the patterns of conductors is omitted.

As shown in FIG. 6, a third insulation sheet 1C having no pattern of conductor on a first face and a second face is provided between patterns of conductors 2B on the second face (rear face) of the first insulation sheet 1A and patterns of conductors 2C on the first face (front face) of the second insulation sheet 1B. Patterns of conductors 2A on the first face (front face) of the first insulation sheet 1A and patterns of conductors 2C on the first face (front face) of the second insulation sheet 1B, and the patterns of the conductors 2B on the second face (rear face) of the first insulation sheet 1A and the patterns of the conductors 2B on the second face (rear face) of the second insulation sheet 1B, are electrically connected by a first via holes A and a second via hole 3B, respectively.

In the multilayered device in accordance with the fifth embodiment, the patterns of the conductors formed on the first face of the first insulation sheet 1A shown in FIG. 5A are electrically connected to the patterns of the conductors formed on the first face of the second insulation sheet 1B shown in FIG. 5B so as to constitute an electrode of a capacitor. On the other hand, the patterns of the conductors formed on the second face of the first insulation sheet 1A shown in FIG. 5C are electrically connected to the patterns of the conductors formed on the second face of the second insulation sheet 1B shown in FIG. 5D so as to constitute another electrode of the capacitor.

The patterns of the conductors formed on the first face of the first insulation sheet 1A and the patterns of the conductors formed on the second face of the second insulation sheet 1B are specifically described. A first conductor 21A in a foldable area 11 of the first insulation sheet 1A in FIG. 5A is connected to a third conductor 121A in a foldable area 111 of the second insulation sheet 1B in FIG. 5B through a via hole 131 (which corresponds to the first via hole 3A in FIG. 6, the same goes for the below cases). The third conductor 121A in the foldable area 111 is connected to a first (SIC: third) conductor 122A in a foldable area 112, and further connected to a first conductor 22A in a foldable area 12 of the first insulation sheet 1A through a via hole 132. The first conductor 22A in the foldable area 12 is connected to a first conductor 23A in a foldable area 13, and further connected to a first (SIC: third) conductor 123A in a foldable area 113 of the second insulation sheet 1B through a via hole 133. The third conductor 123A in the foldable area 113 is connected to a third conductor 124A in a foldable area 114, and further connected to a first conductor 24A in a foldable area 14 of the first insulation sheet 1A through a via hole 134.

Since the patterns of conductors formed on the second face of the first insulation sheet 1A and the patterns of conductors formed on the second face of the second insulation sheet 1B are the same, descriptions of them are omitted. In FIG. 5D, reference symbols 121B to 124B respectively designate fourth conductors in foldable areas 111B to 114B of the second insulation sheet 1B. In addition, reference numerals 71 to 63 respectively designate folding lines between the foldable areas 111 to 114 of the second insulation sheet 1B. Furthermore, reference numerals 141 to 144 respectively designate via holes corresponding to the second via holes 3B.

As mentioned above, the patterns of the conductors formed on the first face and the second face of the first insulation sheet 1A shown in FIG. 5A and FIG. 5C are substantially the same each other, and the patterns of the conductors formed on the first face and the second face of the second insulation sheet 1B shown in FIG. 5B and FIG. 5D are substantially the same each other, and they are located at positions facing each other, so that a capacitor of distributed constant having a larger capacitance is provided.

Sixth Embodiment

Figure 7:
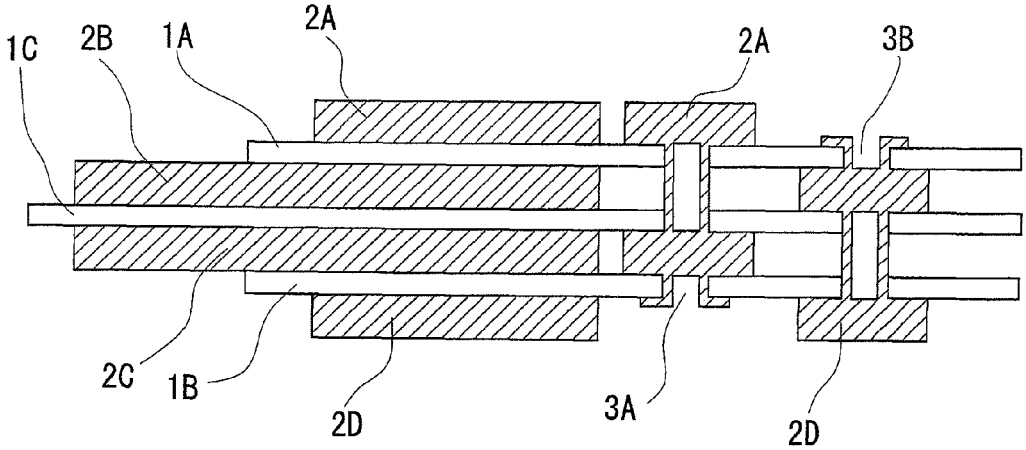
FIG. 7 is a partially expanded sectional view showing a configuration of a multilayered body of an insulation sheets in a sixth embodiment of the present invention.
Figure 8:
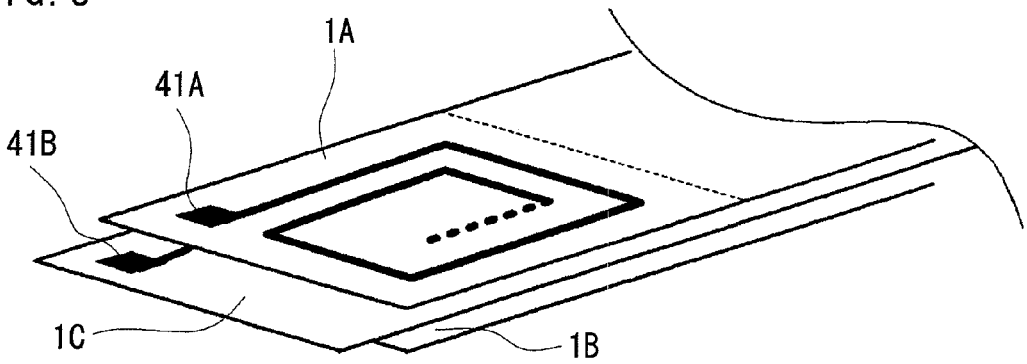
FIG. 8 is a perspective view showing a configuration of a relevant portion of the multilayered body of the insulation sheets in the sixth embodiment.

Subsequently, a multilayered device in accordance with a sixth embodiment is described with reference to FIG. 7 and FIG. 8. FIG. 7 is a partially expanded sectional view showing a configuration of a multilayered body of insulation sheets in the sixth embodiment, and shows a center portion of foldable areas in the multilayered body of insulation sheets. FIG. 8 is a perspective view showing a configuration of a relevant portion of the multilayered body of the insulation sheets in the sixth embodiment. Besides, essential configuration in the sixth embodiment is substantially the same as that in the above mentioned fifth embodiment, so that patterns of conductors formed on first faces and second faces of the insulation sheets will be referred to FIG. 5A to FIG. 5D in the fifth embodiment, arbitrarily.

In comparison with FIG. 6 and FIG. 7, it is found that a part of a pattern of a conductor formed on a first face or a second face of a first insulation sheet 1A and/or a second insulation sheet 1B is formed to protrude from the insulation sheet 1A or 1B, and the protruded portion of pattern of the conductor is supported by a third insulation sheet 1C. For example, a part of a conductor 21B formed on a second face 11B of a foldable area 11 at left end of the first insulation sheet 1A in FIG. 5C, and a part of a conductor 121A formed on a first face 11A of a foldable area 111 at left end of the second insulation sheet 1B in FIG. 5B, are respectively formed to protrude from the first insulation sheet 1A and the second insulation sheet 1B, so that they are exposed on the third insulation sheet 1C from the first insulation sheet 1A and the second insulation sheet 1B In the example shown in FIG. 8, a portion of the connection terminal 41B of the conductor 21B formed on the second face 11B of the foldable area 11 at the left end of the first insulation sheet 1A in FIG. 5C is protruded from the first insulation sheet 1A, so that it is exposed from the first insulation sheet 1A. According to such a configuration, the connection terminals 41 and 42 are arranged in a line, so that wiring connection process such as soldering can be performed on the same side. Consequently, connection process to an external circuit can be performed easier.

Seventh Embodiment

Figure 9:
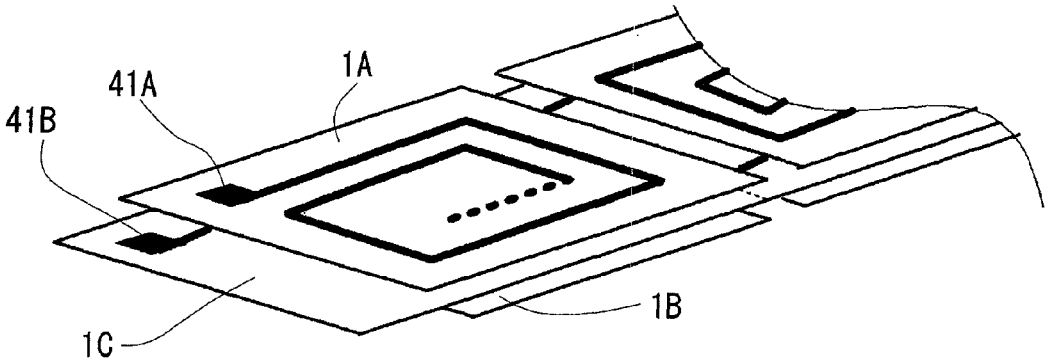
FIG. 9 is a perspective view showing a configuration of a relevant portion of a multilayered body of an insulation sheets in a seventh embodiment of the present invention.

Subsequently, a multilayered device in accordance with a seventh embodiment of the present invention is described with reference FIG. 9. FIG. 9 is a perspective view showing a configuration of a relevant portion of a multilayered body of the insulation sheets in the seventh embodiment. Besides, essential configuration in the seventh embodiment is substantially the same as that in the above mentioned fifth embodiment or sixth embodiment, so that descriptions of patterns of conductors formed on first faces and second faces of the insulation sheets are omitted.

As shown in FIG. 9, in the multilayered device in accordance with the seventh embodiment, a first insulation sheet 1A and/or a second insulation sheet 1B are/is formed of rigid boards by which each foldable area is divided, and a third insulation sheet 1C is formed of a foldable flexible substrate. In addition, it is configured that conductors on adjoining two foldable areas are connected by conductors provided on a face or both faces of the third insulation sheet 1C.

When divided rigid boards are used for the foldable areas of the first insulation sheet 1A and/or the second insulation sheet 1B, the conductors are interrupted at the divided portions. However, when terminals of the conductors are connected through the conductors provided on a face or both faces of the third insulation sheet 1C, wiring in bridging portion of the foldable areas can be secured.

Hereupon, a material for substrate such as polyimide, polyester can be used for the flexible substrate. In addition, glass epoxy, paper phenol, CEM3 can be used for the rigid board.

Eighth Embodiment

Figure 10A:
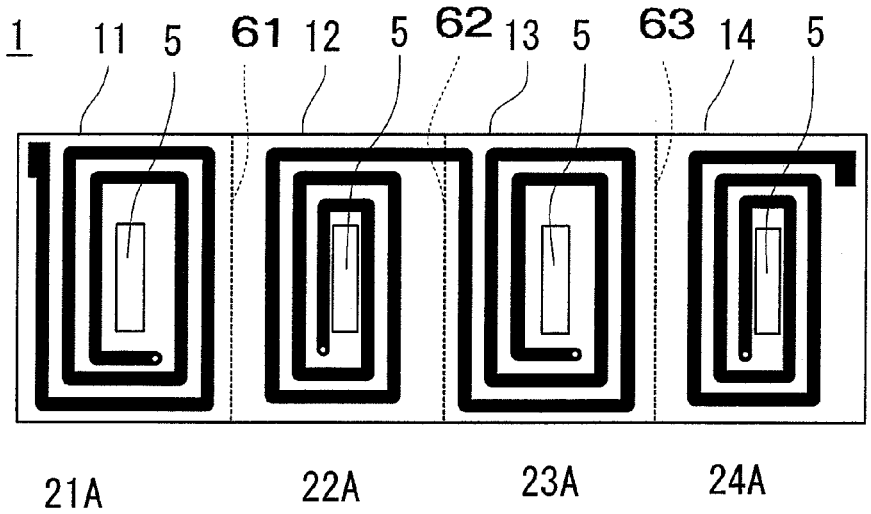
FIG. 10A is a drawing showing patterns of conductors on a first face (front face) of an insulation sheet which is used in a multilayered device in accordance with an eighth embodiment of the present invention.
Figure 10B:
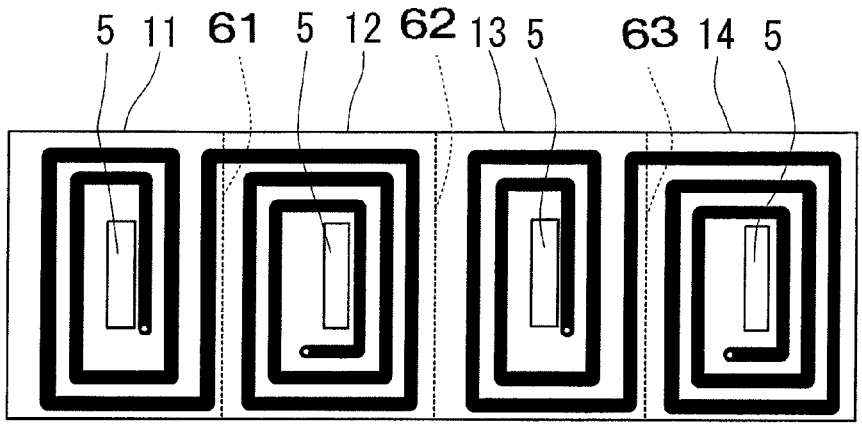
FIG. 10B is a drawing showing patterns of conductors on a second face (rear face) thereof.
Figure 11:
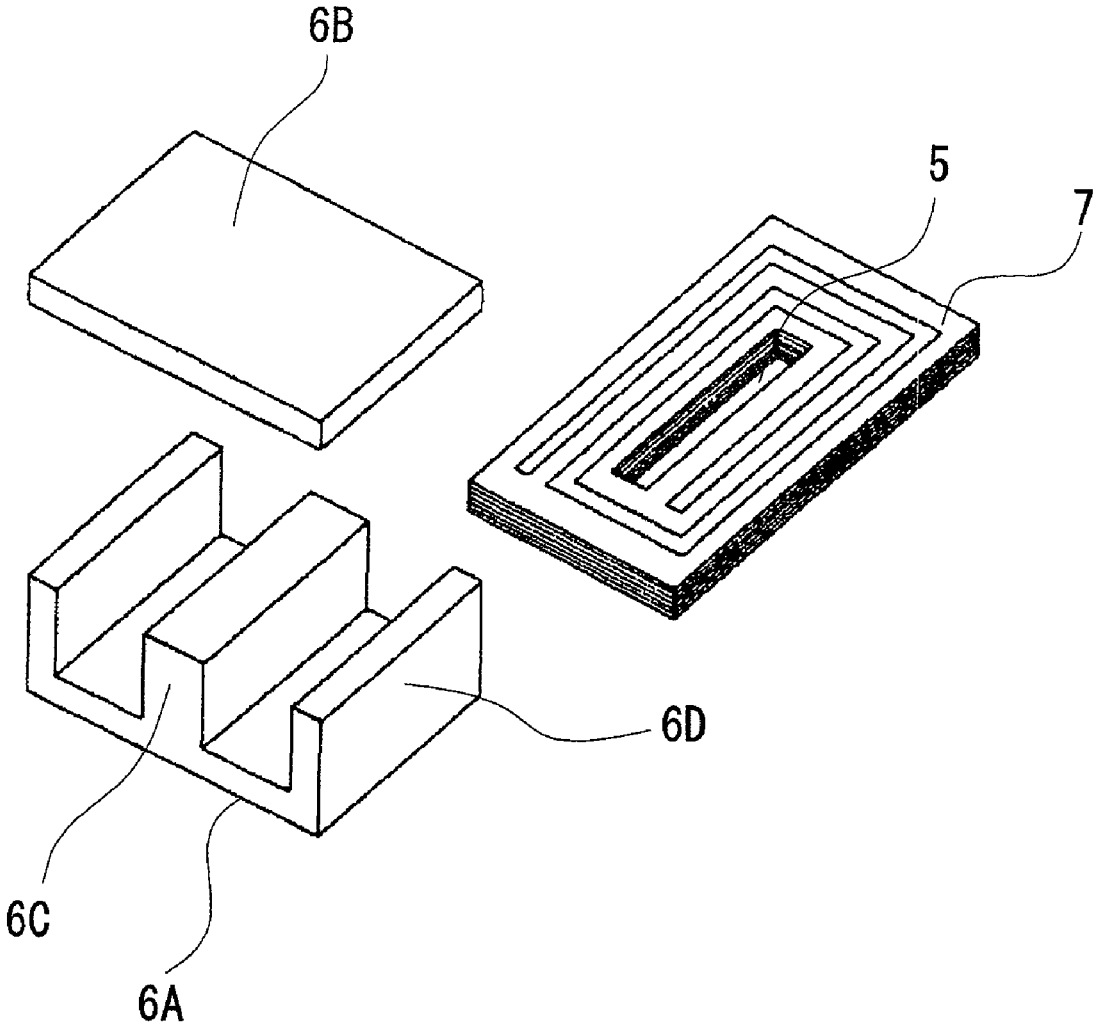
FIG. 11 is a perspective view showing configuration of a multilayered device in accordance with the eighth embodiment and a magnetic core which is used in combination with the multilayered device.

Subsequently, a multilayered device in accordance with an eighth embodiment of the present invention is described with reference to FIG. 10A, FIG. 10B and FIG. 11. In the multilayered device in accordance with the eighth embodiment, a magnetic core is disposed at a center of a coil so as to increase an inductance value. FIG. 10A shows patterns of conductors on a first face (front face) of an insulation sheet which is used in the multilayered device in accordance with the eighth embodiment of the present invention, and FIG. 10B shows patterns of conductors on a second face (rear face) thereof. FIG. 11 is a perspective view showing configuration of the multilayered device in accordance with the eighth embodiment and a magnetic core which is used in combination with the multilayered device. Hereupon, the patterns of the conductors on the rear face shown in FIG. 10B are illustrated as patterns transparently observed from the same side of the patterns of the front face, similar to the above mentioned embodiments.

In the tenth (SIC: eighth) embodiment, an insertion hole 5 is formed at a center portion of each foldable area 11, 12, . . . of the insulation sheet 1 so that a part of the core is inserted into a center portion of each pattern of conductor 21A, 22A, . . . which is wound in convolution and formed on each foldable area 11, 12, . . . of the insulation sheet 1. As shown in FIG. 11, when the insulation sheet 1 is folded along folding lines 31, 32 . . . (SIC) so as to be multilayered, the core insertion holes 5 become a through hole in thickness direction of the multilayered device 7.

As for a magnetic core, a magnetism core 6A having a cross-sectional shape of E and a magnetism core 6B having a cross-sectional shape of I are used in combination, for example. When inserting a center portion 6C or a peripheral portion 6D of the magnetic core 6A into the core insertion hole 5 of the multilayered device 7, an inductance value of the multilayered device 7 can be increased. In addition, in each of the above mentioned first to seventh embodiment, it is possible to increase the inductance value by providing the magnetic core at the center of the coils. Although ferrite core is suitable for the magnetic core, another magnetic body can be used.

(Other Applications)

Figure 12:
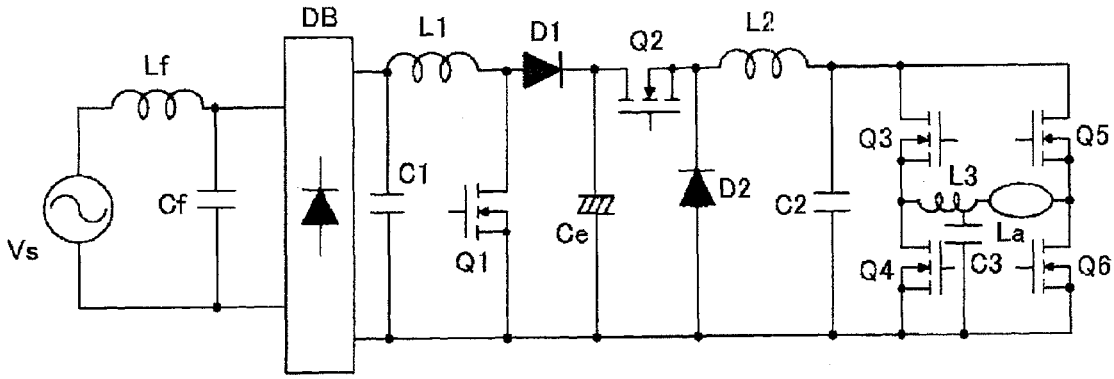
FIG. 12 is a circuit diagram of a lighting apparatus of a discharge lamp which is an application of the multilayered device in accordance with the embodiments of the present invention.

Subsequently another application of the multilayered device in accordance with the above mentioned embodiments of the present invention is described with reference to FIG. 12. FIG. 12 is a circuit diagram of a lighting apparatus of a high voltage discharge lamp using the multilayered device in accordance with the present invention.

In FIG. 12, AC input terminals of a full-wave rectifier DB is connected to an AC power source Vs through a filtering coil Lf and a filtering capacitor Cf. As for the filtering coil Lf and the filtering capacitor Cf, the multilayered device in accordance with each of the above mentioned embodiment can be used, so that the lighting apparatus of the high voltage discharge lamp can be downsized and flattened.

A capacitor C1 is connected between DC output terminals of the full-wave rectifier DB in parallel. Such capacitor C1 has a small capacitance which enables to bypass high frequency component, and a pulsating voltage is outputted from the full-wave rectifier DB by rectifying an AC voltage of the AC power source Vs with full-wave rectification. An inductor L1, a switching device Q and a diode D1 constitute a boosting chopper, and a stable DC voltage is obtained by a step-up capacitor Ce such as an electrolytic capacitor. As for the inductor L1 and the capacitor C1, the above mentioned multilayered device can be used, so that the step-up chopper can be downsized and flattened. However, the multilayered device in accordance with the present invention is not suitable for the smoothing capacitor Ce, because it is configured by an electrolytic capacitor.

A step-down chopper consists of a switching device Q2, an inductor L2 and a diode D2 is connected between both terminals of the smoothing capacitor Ce, so that a DC voltage corresponding to lamp voltage appears in a capacitor C2. Such step-down chopper practically acts as a stabilizer (ballast) of a discharge lamp La. The inductor L2 and the capacitor C2 is configured by using the multilayered device in accordance with the present invention, so that the step-down chopper can be downsized and flattened.

A series circuit of switching devices Q3 and Q4 and a series circuit of switching devices Q5 and Q6 are respectively connected between both terminals of the capacitor C2 in parallel. The discharge lamp La is connected between a connection point of the switching devices Q3 and Q4 and a connection point of the switching devices Q5 and Q5 through an inductor L3. A capacitor C3 is connected between a tap provided in midway of a winding of the inductor L3 and a ground. The inductor L3 and the capacitor C3 are used as a resonance circuit which generates high voltage for dielectric breakdown at the time of starting of the discharge lamp La. In other words, resonance voltage is applied to the resonance circuit of a series connection of the inductor L3 and the capacitor C3 by alternately switching on and off the switching devices Q3 and Q4 in high frequency at the time of starting of the discharge lamp La, so that the discharge lamp La is dielectrically breakdown, and thus, started to light. After starting the discharge lamp La, a state that the switching devices Q3 and Q6 are switched on and the switching devices Q4 and Q5 are switched off and another state that the switching devices Q3 and Q6 are switched off and the switching devices Q4 and Q5 are switched on are alternately repeated in low frequency, so that rectangular wave voltage is supplied to the discharge lamp La. Thereby, a high voltage discharge lamp (HID lamp) such as a mercury-arc lamp or a metal halide lamp can be lit.

Hereupon, the inductor L3 and the capacitor C3 can be configured with using the multilayered device in accordance with the present invention, so that the igniter can be downsized and flattened.

Figure 13:
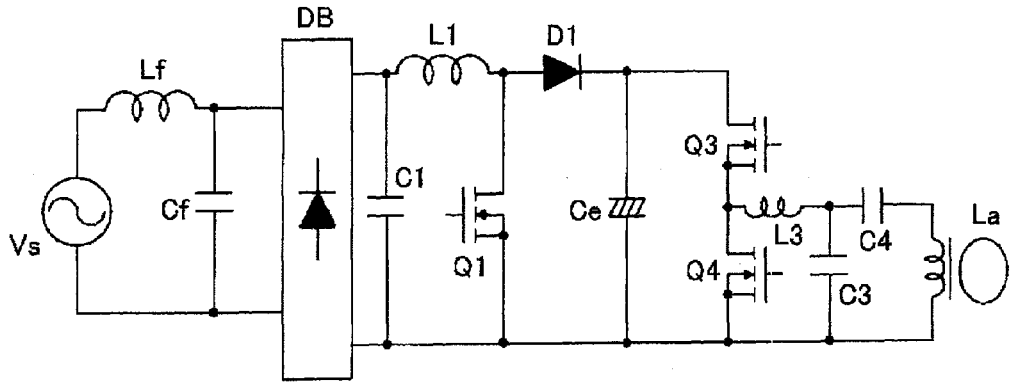
FIG. 13 is a circuit diagram of a lighting apparatus of a discharge lamp which is another application of the multilayered device in accordance with the embodiments of the present invention.
Figure 14:
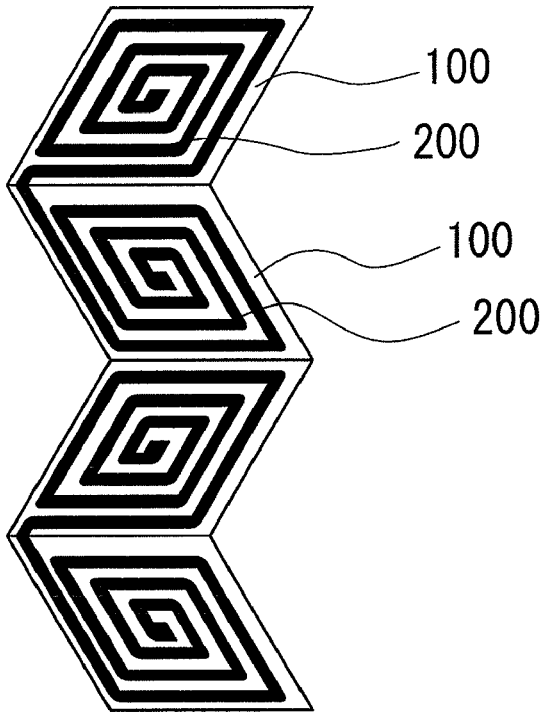
FIG. 14 is a perspective view showing a spread state of an insulation sheet of a conventional multilayered device.
Figure 15A:
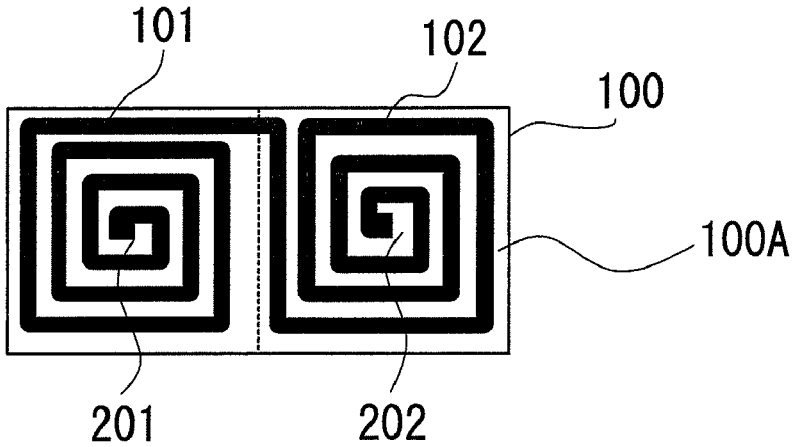
FIG. 15A is a drawing showing patterns of conductors on a first face (front face) of an insulation sheet of the conventional multilayered device.
Figure 15B:
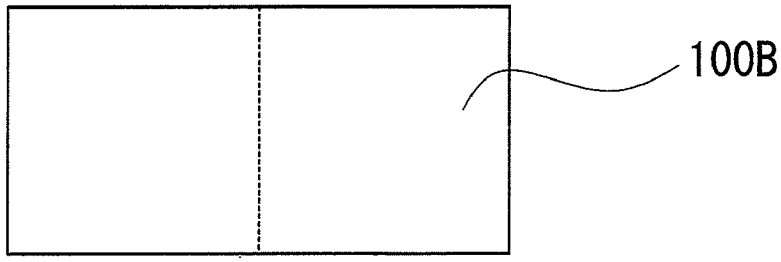
FIG. 15B is a drawing showing a second face (rear face) of the insulation sheet.

FIG. 13 is a circuit diagram of a lighting apparatus of an electrodeless discharge lamp using the multilayered device in accordance with the present invention. Since the configuration to the smoothing capacitor Ce consists of an electrolytic capacitor is substantially the same as that of the lighting apparatus of the high voltage discharge lamp shown in FIG. 12, so that description of overlapped portion is omitted.

In the lighting apparatus of the electrodeless discharge lamp shown in FIG. 13, the multilayered device in accordance with the present invention can be used as a filtering coil Lf and a filtering capacitor Cf, so that a filtering circuit can be downsized and flattened.

In addition, the multilayered device in accordance with the present invention can be used as an inductor L1 and a capacitor C1, so that a step-up chopper can be downsized and flattened. However, the multilayered device in accordance with the present invention is not suitable for the smoothing capacitor Ce, because it is configured by an electrolytic capacitor.

A series circuit of switching devices Q3 and Q4 is connected between both terminals of the smoothing capacitor Ce, and a resonance circuit of a series connection of an inductor L3 and a capacitor C3 is connected between both terminals of the switching device Q4. The switching devices Q3 and Q4 are alternately switched on and off in high frequency, and resonance voltage is generated by resonance action of series connection of the inductor L3 and the capacitor C3. The resonance voltage is applied to an induction coil of the electrodeless discharge lamp La through a capacitor C4 for cutting DC component, so that the electrodeless discharge lamp La is lit in high frequency.

In this lighting apparatus of the electrodeless discharge lamp, the multilayered device in accordance with the present invention can be used as the inductor L3 and the capacitor C3, so that the resonance circuit can be downsized and flattened.

By the way, although the lighting apparatuses for discharge lamp are exemplified as applications of the multilayered device in accordance with the present invention, it is obvious that an inductor or a capacitor for various electric power converting circuit other than the discharge lamp can be configured with using the multilayered device in accordance with the present invention. Furthermore, it is needless to say that the multilayered device in accordance with the present invention can be used as an element of a generic oscillation circuit other than the electric power converting circuit.

Besides, the multilayered device in accordance with the present invention is not limited to the configuration of the above mentioned embodiments, and it is preferable to comprises an insulation sheet (1) having at least two foldable areas (11, 12, 13, 14) which are multilayered by being folded, a first conductor (21A, 22A, 23A, 24A) which is formed on a first face (11A, 12A, 13A, 14A) and constitutes a first coil (51A, 52A, 53A, 54A) having one turn or more, and a second conductor (21B, 22B, 23B, 24B) which is formed on a second face (11B, 12B, 13B, 14B) and constitutes a second coil (21B, 22B, 23B, 24B) having one turn or more in the same winding direction as that of the first coil in each of the foldable areas (11, 12, 13, 14), and wherein at least four conductors are disposed in parallel with each other by folding the insulation sheet (1) so as to constitute an inductor. Consequently, thickness of the multilayer can be made thinner even when a coil device having a larger number of turns is constituted, and thus, a multilayered device which can be downsized and flattened is provided (referring to FIG. 1A to FIG. 4B).

In addition, it is preferable to comprise a via hole (31, 32, 33, 34) which is formed to penetrate from the first face (11A, 12A, 13A, 14A) to the second face (11B, 12B, 13B, 14B) and conducts an end of the first conductor (21A, 22A, 23A, 24A) and an end of the second conductor (21B, 22B, 23B, 24B) in each foldable are (11 and 12, 12 and 13 or 13 and 14) of the insulation sheet (1).

With respect to the first foldable area and the second foldable area adjoining to each other (11 and 12, 12 and 13, or 13 and 14), the first conductor (22A) on the first face (12A) of the first foldable area (12) and the first conductor (13A) (SIC: 23A) on the first face (13A) of the second foldable area (13) or the second conductor (21B, 23B) on the second face (11B, 13B) of the first foldable area (11, 13) and the second conductor (22B, 24B) on the second face (12B, 14B) of the second foldable area (12, 14) is successively formed to bridge over a folding line between the first foldable area and the second foldable area.

Under a state that the insulation sheet (1) is folded, a winding direction of the first coil (51A) and the second coil (51B) of the first foldable area (for example, 11) and a winding direction of the first coil (52A) and the second coil (52B) of the second foldable area (for example, 12) are opposite to each other (referring to FIG. 1A, FIG. 1B, FIG. 2A and FIG. 2B).

Alternatively, it is preferable to comprise a via hole (31, 32) which is formed to penetrate from the first face (11A, 12A) to the second face (11B, 12B) and conducts an end of the first conductor (21A, 22A) and an end of the second conductor (21B, 22B) in each foldable are (11, 12) of the insulation sheet (1).

With respect to arbitrary of the first foldable area (11) and the second foldable area (12), a primary coil is constituted by the first conductor (21A) on the first face (11A) and the second conductor (21B) on the second face (11B) of the first foldable area (11), and a secondary coil is constituted by the first conductor (22A) on the first face (12A) and the second conductor (22B) on the second face (12B) of the second foldable area (12), and thus, a transformer is configured by magnetically coupling the first coil and the second coil (referring to FIG. 3A and FIG. 3B).

Alternatively, with respect to the first foldable area (11) and the second foldable area (12) adjoining each other, it is preferable that the first conductor (21A) on the first face (11A) of the first foldable area (11) and the first conductor (22A) on the first face (12A) of the second foldable area (12) and the second conductor (21B) on the second face (11B) of the first foldable area (11) and the second conductor (22B) on the second face (12B) of the second foldable area (12) are successively formed to bridge over a first folding line (61) between the first foldable area (11) and the second foldable area (12), respectively.

A capacitor of distributed constant is further constituted between the first conductor (21A) on the first face (11A) of the first foldable area (11) and the first conductor (22A) on the first face (12A) of the second foldable area (12), and the second conductor (21B) on the second face (11B) of the first foldable area (11) and the second conductor (22B) on the second face (12B) of the second foldable area (12) (referring to FIG. 4A and FIG. 4B).

Furthermore, under a state that the insulation sheet (1) is folded so that the foldable areas (11, 12, 13, 14) are multilayered, it is preferable to have a magnetic core (6A, 6B) disposed at a center of the first coil and the second coil, so that an inductance value is increased thereby (referring to FIG. 10 and FIG. 11).

Alternatively, it is preferable to provide a second insulation sheet (1B) which is another insulation sheet provided in parallel with the insulation sheet (hereinafter, it is called the first insulation sheet (1A)), and has at least two foldable area which are multilayered by being folded.

In each foldable area (111, 112, 113, 114) of the second insulation sheet (1B), a third conductor (121A, 122A, 123A, 124A) which is formed on a first face (111A, 112A, 113A, 114A) and constitutes a third coil having one turn or more, and a fourth conductor (121B, 122B, 123B, 124B) which is formed on a second face (111B, 112B, 113B, 114B) and constitutes a fourth coil having one turn or more in the same winding direction as that of the third coil are further provided.

An end of the first conductor (21A, 22A, 23A, 24A) on the first face (11A, 12A, 13A, 14A) of the foldable area (11, 12, 13, 14) of the first insulation sheet (1A) and an end of the third conductor (121A, 122A, 123A, 124A) on the first face (111A, 112A, 113A, 114A) of the foldable area (111, 112, 113, 114) of the second insulation sheet (1B) corresponding to the foldable area are conducted through a first via hole (131, 132, 133, 134) formed to penetrate through the first insulation sheet (1A) so as to constitute an inductor.

An end of the second conductor (21B, 22B, 23B, 24B) on the second face (11B, 12B, 13B, 14B) of the foldable area (11, 12, 13, 14) of the first insulation sheet (1A) and an end of the fourth conductor (121B, 122B, 123B, 124B) on the second face (111B, 112B, 113B, 114B) of the foldable area (111, 112, 113, 114) of the second insulation sheet (1B) corresponding to the foldable area are conducted through a second via hole (141, 142, 143, 144) formed to penetrate through the second insulation sheet (1B) so as to constitute an inductor.

A capacitor of distributed constant is constituted between a conductor configured by the first conductor (21A, 22A, 23A, 24A) and the third conductor (121A, 122A, 123A, 124A) and a conductor configured by the second conductor (21B, 22B, 23B, 24B) and the fourth conductor (121B, 122B, 123B, 124B) (referring to FIG. 5A to FIG. 5D, and FIG. 6).

Furthermore, it is preferable that a number of the foldable areas of the first insulation sheet (1A) and the second insulation sheet (1B) is two or a multiple number of two.

Connection terminals (41A, 41B, 44A, 44B), which are to be connected to external circuits, are formed on the first conductor (21A, 121A) on the first face and the second conductor (24A, 124A) of two foldable areas (11, 14) at both ends of the first insulation sheet (1A). With respect to other foldable areas, ends of the first conductor (22A, 23A) which are opposite to other ends thereof conducted to the third conductors (122A, 123A) through the first via holes (132, 133) and ends of the second conductor (22B, 23B) which are opposite to other ends thereof conducted to the fourth conductors (122B, 123B) through the second via holes (142, 143) are successively formed to bridge over a folding line (62) between the adjoining two foldable areas (12, 13).

With respect to two foldable areas (111 and 112, 113 and 114) of the second insulation sheet (1B), in each adjoining two foldable areas from an end thereof, ends of the third conductor (121A and 122A, 123A and 124A) which are opposite to other ends thereof conducted to the first conductors (21A and 22A, 23A and 24A) through the first via holes (131, 132, 133, 134) and ends of the fourth conductor (121B and 122B, 123B and 124B) which are opposite to other ends thereof conducted to the second conductors (21A and 22A, 23A and 24A) (SIC: 21B and 22B, 23B and 24B) through the second via holes (141, 142, 143, 144) are successively formed to bridge over folding lines (71, 73) between the adjoining two foldable areas (referring to FIG. 5A to FIG. 5D).

Still furthermore, it is preferable that a third insulation sheet (1C) is further comprised to be inserted between the first insulation sheet (1A) and the second insulation sheet (1B), and both of the first via holes (3A, 131-134) and the second via holes (3B, 141-144) are formed to penetrate the third insulation sheet (1C) (referring to FIG. 6).

Still furthermore, a portion of the third insulation sheet (1C) facing at least one foldable area (11, 111) among the foldable areas of the first insulation sheet (1A) and the second insulation sheet (1B) has dimensions larger than those of the at least one foldable area (11, 111), parts of or a part (41A) (SIC: 41A and/or 41B) of the second conductor (2B) of the first insulation sheet (1A) and/or the third conductor (2C) of the second insulation sheet (1B) in the at least one foldable area (11, 111) are/is exposed on the third insulation sheet (1C) protruded from the at least one foldable area (referring to FIG. 7 and FIG. 8).

Still furthermore, it is preferable that the first insulation sheet (1A) and/or the second insulation sheet (1B) are/is formed of rigid boards which are divided for each foldable area and the third insulation sheet (1C) is formed of a foldable flexible substrate, and connections of the conductors in an area between the foldable areas adjoining each other is performed through conductors formed on both faces or one face of the third insulation sheet (1C) (referring to FIG. 9).

Still furthermore, it is preferable further to comprise a magnetic core (6A, 6B) disposed at centers of the first coil, the second coil, the third coil and the fourth coil under a state that a multilayered body of the first insulation sheet (1A) and the second insulation sheet (1B) is folded so that foldable areas are piled up, so that an inductance value is increased (referring to FIG. 10 and FIG. 11).

This application is based on Japanese patent application 2007-16737 filed in Japan, the contents of which are hereby incorporated by references of the specification and drawings of the above mentioned Japanese patent application.

Although the present invention has been fully described by way of example with reference to the accompanying drawings, it is to be understood that various changes and modifications will be apparent to those skilled in the art. Therefore, unless otherwise such changes and modifications depart from the scope of the present invention, they should be construed as being included therein.

The invention claimed is:

1. A multilayered device comprising:

a first insulation sheet having at least two foldable areas which are multilayered by being folded; and a second insulation sheet which is provided in parallel with the first insulation sheet, and has at least two foldable areas which are multilayered by being folded, wherein each of the foldable areas of the first insulation sheet includes a first conductor which is formed on a first face of the first insulation sheet and constitutes a first coil having one turn or more, and a second conductor which is formed on a second face of the first insulation sheet and constitutes a second coil having one turn or more in the same winding direction as that of the first coil, each of the foldable areas of the second insulation sheet includes a third conductor which is formed on a first face of the second insulation sheet and constitutes a third coil having one turn or more, and a fourth conductor which is formed on a second face of the second insulation sheet and constitutes a fourth coil having one turn or more in the same winding direction as that of the third coil, an end of the first conductor on the first face of each of the foldable areas of the first insulation sheet is connected to an end of the third conductor on the first face of a corresponding foldable area of the second insulation sheet through a first via hole formed to penetrate through the first insulation sheet so as to constitute an inductor;

an end of the second conductor on the second face of each of the foldable areas of the first insulation sheet is connected to an end of the fourth conductor on the second face of a corresponding foldable area of the second insulation sheet through a second via hole formed to penetrate through the second insulation sheet so as to constitute an inductor; and a capacitor having a distributed constant is between a conductor formed by the first conductor and the third conductor and a conductor formed by the second conductor and the fourth conductor, and at least four conductors are disposed in parallel with each other by folding the first insulation sheet so as to constitute an inductor.

2. The multilayered device in accordance with claim 1, wherein the first via hole of each foldable area connects an end of the first conductor of the foldable area to an end of the second conductor of the foldable area;

with respect to the first foldable area and the second foldable area adjoining to each other, the first conductor on the first face of the first foldable area and the first conductor on the first face of the second foldable area or the second conductor on the second face of the first foldable area and the second conductor on the second face of the second foldable area is successively formed to bridge over a folding line between the first foldable area and the second foldable area; and under a state that the insulation sheet is folded, a winding direction of the first coil and the second coil of the first foldable area and a winding direction of the first coil and the second coil of the second foldable area are opposite to each other.

3. The multilayered device in accordance with claim 1, wherein the first via hole of each foldable area connects an end of the first conductor of the foldable area to an end of the second conductor of the foldable area; and with respect to arbitrary of the first foldable area and the second foldable area, a primary coil is constituted by the first conductor on the first face and the second conductor on the second face of the first foldable area, and a secondary coil is constituted by the first conductor on the first face and the second conductor on the second face of the second foldable area, and thus, a transformer is configured by magnetically coupling the first coil and the second coil.

4. The multilayered device in accordance with claim 1, wherein with respect to the first foldable area and the second foldable area adjoining each other, the first conductor on the first face of the first foldable area and the first conductor on the first face of the second foldable area and the second conductor on the second face of the first foldable area and the second conductor on the second face of the second foldable area are successively formed to bridge over a first folding line between the first foldable area and the second foldable area, respectively; and a capacitor of distributed constant is further constituted between the first conductor on the first face of the first foldable area and the first conductor on the first face of the second foldable area, and the second conductor on the second face of the first foldable area and the second conductor on the second face of the second foldable area.

5. The multilayered device in accordance with claim 1, wherein under a state that the insulation sheet is folded so that the foldable areas are multilayered, a magnetic core is disposed at a center of the first coil and the second coil, so that an inductance value is increased.

6. The multilayered device in accordance with claim 1, wherein a magnetic core is disposed at centers of the first coil, the second coil, the third coil and the fourth coil under a state that a multilayered body of the first insulation sheet and the second insulation sheet is folded so that foldable areas are stacked, so that an inductance value is increased.

7. The multilayered device in accordance with claim 1, wherein a number of the foldable areas of the first insulation sheet and the second insulation sheet is two or a multiple number of two;

connection terminals, which are to be connected to external circuits, are formed on the first conductor and the second conductor of two foldable areas positioned at ends of the first insulation sheet, in each of the foldable areas of the first insulation sheet which are not positioned at the ends of the first insulation sheet, an end of the first conductor which is not connected to an end of the third conductor through the first via hole bridges a folding line to connect to a first conductor of an adjoining foldable area, and an end of the second conductor which is not connected to an end of the fourth conductor through the second via hole bridges a folding line to connect to a second conductor of an adjoining foldable area, and in each of the foldable areas of the second insulation sheet which are not positioned at the ends of the second insulation sheet, an end of the third conductor which is not connected to an end of the first conductor through the first via hole bridges a folding line to connect to a third conductor of an adjoining foldable area, and an end of the fourth conductor which is not connected to an end of the second conductor through the second via hole bridges a folding line to connect to a fourth conductor of an adjoining foldable area.

8. The multilayered device in accordance with claim 1, further comprising a third insulation sheet which is further inserted between the first insulation sheet and the second insulation sheet, wherein the first via holes and the second via holes are formed to penetrate the third insulation sheet.

9. The multilayered device in accordance with claim 1, wherein a portion of the third insulation sheet facing at least one foldable area among the foldable areas of the first insulation sheet and the second insulation sheet has dimensions larger than those of the at least one foldable area, and part of a second conductor or a third conductor of the at least one foldable area protrudes from the at least one foldable area.

10. The multilayered device in accordance with claim 1, wherein at least one of the first insulation sheet and the second insulation sheet is formed of rigid boards provided for each foldable area, the third insulation sheet is formed of a foldable flexible substrate, and connections of the conductors in an area between the foldable areas adjoining each other is performed through conductors formed on both faces or one face of the third insulation sheet.

* * * * *